US006035536A

United States Patent [19]

Dewberry

[11] Patent Number: 6,035,536

[45] Date of Patent: Mar. 14, 2000

[54] CAULK BEAD REMOVAL TOOL

[75] Inventor: Andrew Dewberry, Vancouver, Canada

[73] Assignee: Vancouver Tool Corporation, Vancouver

[21] Appl. No.: 09/217,155

[22] Filed: Dec. 21, 1998

[30] Foreign Application Priority Data

Dec. 22, 1997 [CA] Canada ..... 2219468

[51] Int. Cl.[7] ..... B26B 3/00

[52] U.S. Cl. ..... 30/169; 15/235.7

[58] Field of Search ..... 30/169, 170; 15/236.01, 15/105.5, 235.3, 235.7; 425/458, 87

[56] References Cited

U.S. PATENT DOCUMENTS

| | | | |
|---|---|---|---|
| 2,883,854 | 4/1959 | Marmon | 15/236.01 X |
| 3,498,101 | 3/1970 | Daniell . | |
| 3,744,079 | 7/1973 | Krause . | |
| 3,761,992 | 10/1973 | Schneller . | |
| 3,846,060 | 11/1974 | Otis . | |
| 3,878,581 | 4/1975 | Perna . | |
| 4,586,890 | 5/1986 | Marchbanks . | |
| 4,673,346 | 6/1987 | Anderson . | |
| 5,018,956 | 5/1991 | Lemaster . | |
| 5,033,951 | 7/1991 | Cook . | |
| 5,058,275 | 10/1991 | Staubli | 30/170 |
| 5,075,916 | 12/1991 | Englehart . | |
| 5,239,725 | 8/1993 | White . | |
| 5,440,776 | 8/1995 | Kartler . | |
| 5,675,860 | 10/1997 | Campbell . | |

FOREIGN PATENT DOCUMENTS

| | | |
|---|---|---|
| 385244 | 12/1932 | United Kingdom . |
| 844416 | 12/1958 | United Kingdom . |
| WO 94/27001 | 11/1994 | WIPO . |
| WO 97/13047 | 4/1997 | WIPO . |

OTHER PUBLICATIONS

EP Search Report for EP 98 3109589, Aug. 5, 1999.

*Primary Examiner*—Douglas D. Watts
*Attorney, Agent, or Firm*—Kolisch Hartwell Dickinson McCormack & Heuser

[57] ABSTRACT

A hand held tool for the removal of a cured bead of caulk, sealant or other previously fluent material from a joint between substantially perpendicular surfaces. The tool comprises an elongate handle with two working heads. The primary working head at one end of the longitudinal axis of the handle features a chisel-like point angled down from the upper face of the handle and extending between two symmetrical flanking planes which are acutely angled to each other and also spread from the body of the handle. The planes are bevelled to form sharp edges for scraping surfaces during an operation to remove a bead whilst the chisel-like point chisels the body of the bead from the joint. Axially opposite the primary head the second working head is essentially an angled chisel-like point extended from the upper face of the handle and is used to chisel, pick or gouge a bead from a joint.

10 Claims, 2 Drawing Sheets

CAULK BEAD REMOVAL TOOL

BACKGROUND OF THE INVENTION

This invention relates generally to tools utilized for cutting, scraping, chiselling and gouging cured beads of caulk, sealant or other previously fluent materials (hereinafter referred to only as "caulk") from joints. More particularly, the invention relates to apparatus for cutting and chiselling beads of caulk from joints and the scraping of caulk from surfaces.

Many tools are available in the prior art to facilitate the removal of caulk from joints. The operation of removal of caulk is primarily undertaken as a maintenance procedure prior to the application of a fresh bead of caulk where the existing sealing performed by the caulk bead in place has failed or where the joint has visibly deteriorated to an extent deemed unacceptable. Some caulk removal tools are specially designed for particular, specialized fields such as the removal of caulk in window glass installations, however, these window glass tools are not suitable for use in more general applications. In the general instance of caulk extraction for the purpose of preparation prior to the application of a fresh bead of caulk, the current state of the art involves assembling a multiplicity of tools and the dexterous use thereof. Chief among the various tools used in the art are utility knives, various forms of scrapers and various gouges. In operation, a user might use the knife blade to cut into and release the caulk bead from the surfaces adjacent to the joint to which it is adhered. A gouging tool is then used to extract the caulk from within the joint, and lastly the user will use various scraping tools to remove any residue caulk from the adjacent surfaces. This process is continued repetitively until a satisfactory result is achieved and a sufficiently sound base for the application of a replacement bead of caulk is obtained. However, in as much as the average user rarely has call to perform the above operation and thereby become skilled in the practice, and where variety in configuration of the joint, the nature of the adjacent surfaces and the types of caulking material originally used requires the user to be experienced in the exercise and use of the various tools available at each unique extraction operation, it is not surprising that the quick and efficient removal of caulk beads is rarely achieved. Moreover, inasmuch as the user often is not experienced in the above described removal procedures which involve sharp steel tools, there is considerable opportunity for damage to be sustained upon surfaces adjacent to the joint.

The prior art has more recently expanded to include chemical solvent removal. This technique involves the use of fixotropic emulsion containing solvent suitable for the particular caulking material to be removed from the joint. The user is instructed to apply the compound liberally in a well aired environment taking care to avoid skin contact with the emulsion and leave to stand before cleaning the residue away using a scraper. The operation is then repeated until the caulk is removed in its entirety at which point the practitioner is required to wash the joint and its adjacent surfaces clean of any trace of the solvent prior to applying a new caulk bead. Though this process requires less dexterity than the removal process with tools, a correct analysis of the existing bead, time consuming repetition and thorough final cleaning are necessary, and the opportunity to cause inadvertent damage to surfaces remains with the use of steel scrapers. Using the chemical technique also allows the user to achieve the complete removal of all cured caulk from the joint even where fully adhered deep within the recess of the joint itself, which may be deemed an unnecessary extension of the operation.

It is the opinion of the present inventor that the prior art is redolent with opportunity for failure by placing excessive demands upon the unskilled practitioner to follow with care and expertise numerous steps including the choice of tool or materials and the dexterous use of such articles in the achievement of the desired goal. It would seem a reasonable assumption that if the current slow, laborious and complicated act of caulk extraction is simplified as an operation, there would be less reticence in undertaking the operation, less damage sustained to adjacent surfaces during the operation and a more consistently sound base for the introduction of a fresh bead of caulk. As a consequence, the potential for premature caulk bead failure might be reduced and a more timely maintenance response might be promoted where failure of the seal has occurred.

SUMMARY OF THE INVENTION

In view of the foregoing comments, there exists a need for a tool to permit quick and efficient removal and preparation of an existing caulk joint to receive new caulk.

The resilient and flexible hand held tool of the present invention provides a unitary elongated member configured for combined cutting, chiselling and scraping operations upon a bead of cured caulk from a joint and its adjacent surfaces.

Accordingly, the present invention provides a tool for the removal of a bead of caulk, sealant or other material from a joint at the intersection of two adjacent surfaces, comprising:

an elongate handle;

a working head at one end of the handle comprising a rigid tip and a pair of flexible guide members extending on opposite sides of the tip;

whereby the tip acts to cut and lift the bead from the adjacent surfaces of the joint on insertion of the tip into the bead and advancement of the tool along the joint with the guide members engaging the two adjacent surfaces to assist in guidance and centring of the tip in the joint.

In one embodiment, the tool of the present invention is constructed as a unitary member of resilient plastic material comprising an elongate handle with a longitudinal cavity, a face plane and less broad side planes exhibiting ridged finger-grip indentations. At opposite ends of the handle are two distinct working heads. The first working head is composed of two angled planes splayed from the longitudinal axis of the handle, one on each side of and connected to an angled central plane which extends into a cutting and chiselling point. The chiselling point is central to the longitudinal axis of the handle. The central plane and the cutting and chiselling point of the first working head are set at an angle of approximately 45 degrees to the face plane of the handle. The angled planes are both attached jointly subtending a slightly acute angle centred symmetrically on the longitudinal axis. The same angled planes also splay from the junction of the handle and the central plane of the cutting and chiselling point each at a small angle approximating 20 degrees or less. The angled planes act to support the cutting and chiselling central point by seating firmly against both adjacent surfaces to a caulked joint, and have all unattached edges bevelled to form sharp scraping or cutting edges.

Opposite the first working head at the other end of the handle, there is a second working head comprising a hook member that extends downwardly and away from the upper face plane of the handle. Reversing the tool in the hand, the user can employ the second working head by pushing the point into a caulk bead and pulling the tool along the bead in order to pick, cut and gouge caulk from joints inaccessible by the first working head. The second working head is particularly useful in corners at the junction of three adjacent surfaces.

BRIEF DESCRIPTION OF THE DRAWINGS

Aspects of the present invention are illustrated, merely by way of example, in the accompanying drawings in which.

DETAILED DESCRIPTION OF A PREFERRED EMBODIMENT

Figure 1:
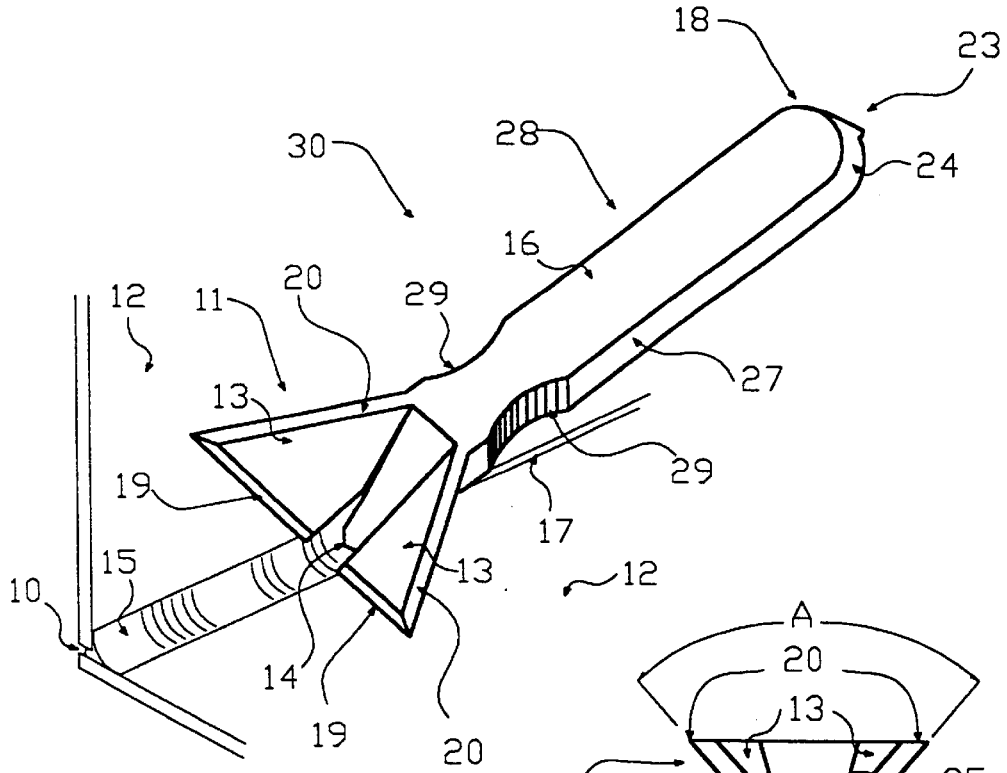
FIG. 1 is a perspective view of a preferred embodiment of the tool of the present invention, shown applied against an existing caulk beaded joint between two surfaces.

Referring initially to FIG. 1, a preferred embodiment of a caulk removal tool according to the present invention 30 is shown including a first working head 11 for the removal of surface caulk sealant, an elongate handle 28, and a second working head 18 for the extraction of caulking from within the cavity of a joint. The tool as shown is a single piece molding cast in plastic. Many plastics may be used to achieve the bare function of the tool, however, the preferred plastic is resistant to abrasion and resilient. Dense polycarbonate, acrylic or similar plastics are preferred.

Figure 5:
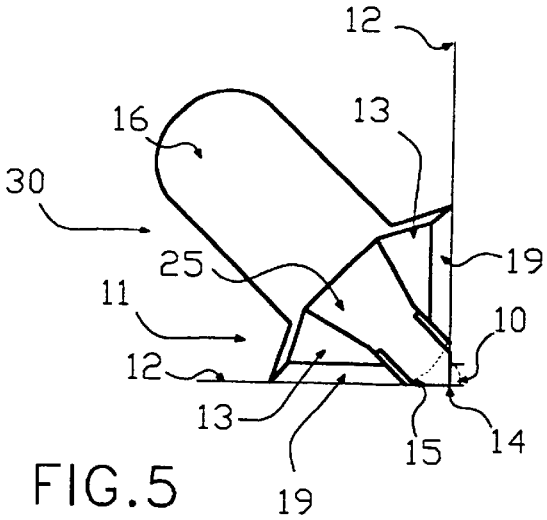
FIG. 5 is an end view of the tool of FIG. 1 illustrating the application of the first working head of the tool into the angle of an existing caulked joint.
Figure 6:
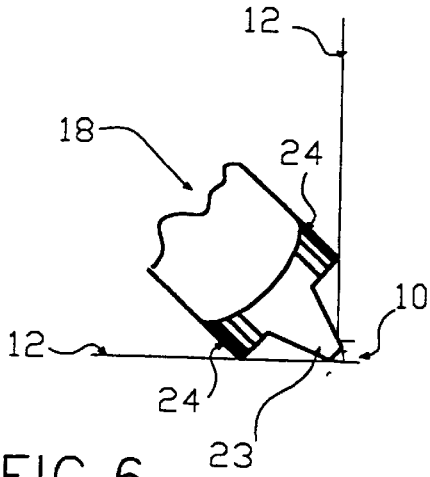
FIG. 6 is an end view showing the application of the second working head into the cavity of an existing caulked joint between two surfaces.

The tool is illustrated with the first working head 11 held against two generally perpendicular surfaces 12 between which a joint 10 is formed defined by a seal formed from a finished and cured bead of caulk 15. The tool includes a rigid tip formed into a sharp cutting chisel pointed element 14 which is pressed into the bead 15 to the extent of the internal angle formed between the perpendicular surfaces 12. The tool also includes two flexible guide members defined by symmetrical angled planes 13 positioned on opposite sides of rigid tip 14. Angled planes 13 are formed with sharply bevelled front edges 19. Angled planes 13 are engaged against surfaces 12 along the length of the sharply bevelled front edges 19 so that working head 11 is seated and centred accurately (as shown FIG. 5) at bead 15 for the process of caulk removal to begin. The operator of the tool will grip the handle portion 28 in one hand using the ribbed indentations 29 to gain additional finger purchase and firmly placing the rounded end of the second working head 18 in the palm of the hand. In this manner, pressure from the arm is efficiently and effectively transferred along the length of the handle to the first working head 11. A removal operation will require the practitioner to push the tool along the bead 15, whereby the front edges 19 of planar surfaces 13 will detach the caulk adhered to the surfaces 12 adjacent to the joint 10 whilst the cutting and chiselling point 14 will break into the body of the bead 15 and chisel the caulk from the joint. The extracted string of caulk is then routed away from the operative edges via a V-shaped channel defined between planar surfaces 13 and plane 25 of tip 14.

To ensure the most general hand fitment and ease of use of the tool, the handle in this preferred embodiment is approximately 100 mm from finger indentations to the rounded end at its axial extremity with an upper face plane 16 of approximately 20 mm and identical parallel side faces 27 of approximately 12 mm symmetrically disposed about the longitudinal axis of the upper face plane. These three faces define the lateral extents of a cavity 21 shown in FIG. 7 defined longitudinally by a plane 25 of the first working head 11 of the tool at approximately 45 degrees to the upper face plane 16 and a curved plane 24 of the second working head 18 angled C (in FIG. 7) from the upper face plane at the longitudinally opposite end of the tool. The walls of all elements of the tool are cast at approximately 2 mm thick.

Figure 2:
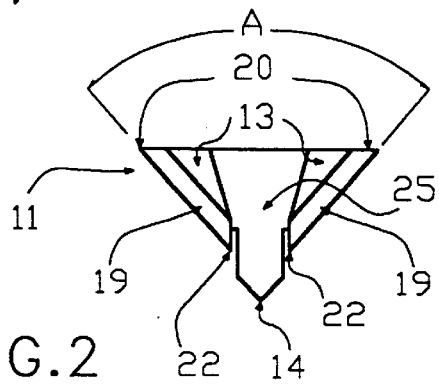
FIG. 2 is an end view of the same tool as shown in FIG. 1.
Figure 3:
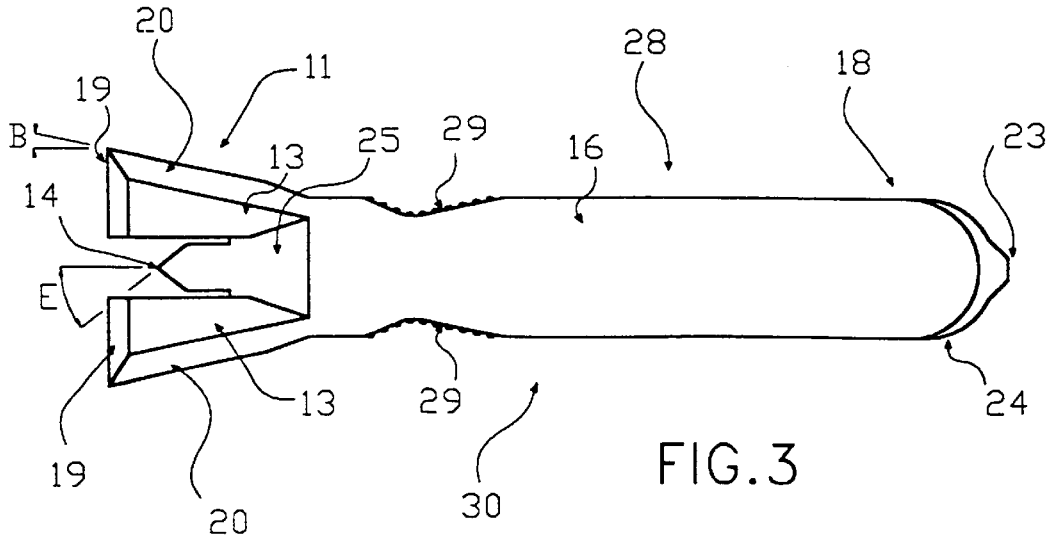
FIG. 3 is a top plan view of the tool of FIG. 1.
Figure 4:
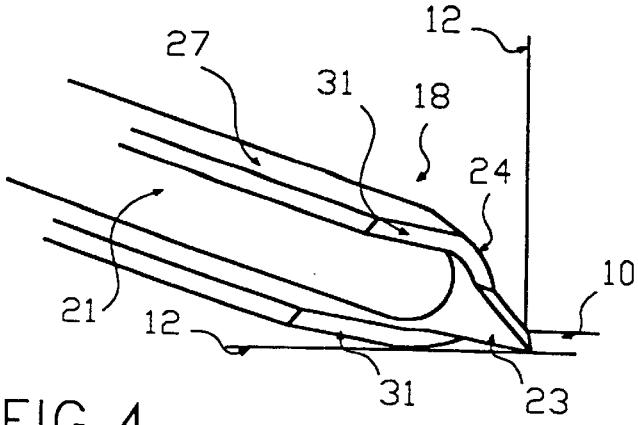
FIG. 4 is a partial perspective view of the under side of the end of the tool opposite the first working head showing the second working head being applied to a cavity within the angle of an existing caulked joint.

Referring to FIG. 2, plane 25 is defined by the upper surface of the rigid, bevelled chisel point 14 that extends downwardly and forwardly from the front end of the tool handle. The rigid tip is symmetric and initially trapezoid as it extends from the handle to terminate in a parallel sided projection of lesser width than the lower edge of the trapezoid. The rigid tip culminates in a bevelled chisel-point 14 that is located symmetrically between angled planes 13. Planes 13 extend forwardly from the handle end to mutually subtend at an angle A less than or equal to ninety degrees. Each angled plane or guide member 13 is generally trapezoidal and has three unattached or free edges with the fourth edge connected to plane 25 via an angled intermediary triangular plane 32 (shown in FIG. 7). The foregoing arrangement affords rigidity in the construction and also forms a V-shaped channel for the guidance of stripped caulk bead away from the operative edges 14 and 19. Each angled plane 13 extends outwardly from the longitudinal axis of the handle at the plane's point of attachment to handle 16 and plane 25 at an angle shown in FIG. 3 as B. One edge 20 of each angled plane 13 is bevelled to be planar with the upper face of the handle 16. The foremost edge 19 at the axial extremity of the tool is perpendicular to the face plane of the handle, but bevelled at approximately 45 degrees towards the cutting and chiselling point to form cutting and scraping edges. The final edge 22 of angle plane 13 is bevelled perpendicular to the face plane of the handle to avoid interference with the removal of extracted caulk away from the operative edges and to form a sharp corner at the junction of the two edges 19 and 22 designed to cut into the extremity of a bead of caulk when the tool is initially pressed into a joint.

The first working head is designed and constructed to facilitate flexing of the angled planes 13 to allow the smooth and controlled movement of the tool in operation of over potentially jagged surfaces, and, in practice with the acrylic or polycarbonate material of preference. In a preferred embodiment, angle A is approximately 82.5 degrees and angle B is approximately 12 degrees.

The sharp cutting and chiselling point 14 is formed as an extension of plane 25 preferably by a pair of symmetric acute angle cuts (FIG. 3) of approximately 80 degrees.

Figure 7:
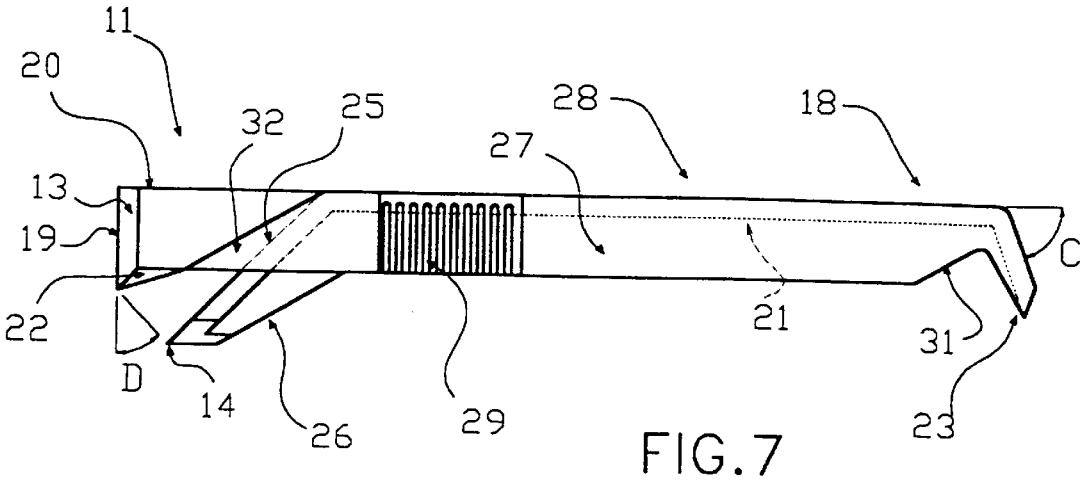
FIG. 7 is a side elevation view of the tool.

Referring to FIG. 7, there is shown the position of tip 14 and plane 25 with respect to the leading edges 19 of the angled planes 13. Through trial tests, angle D is preferably approximately 45 degrees, though this varies with the flexural nature of the material. FIG. 7 also shows a structural support 26 for the plane 25 introduced to prevent excessive flexing of the plane 25 potentially causing premature breakage.

The second working head 18 comprises a protruding hook member adapted for insertion into a joint. Preferably, second working head 18 is formed from a curved plane 24 that extends away from the handle at an angle C from the face plane of the handle with angled cuts 31 at the sides of the handle defining a hook member extending from the curved plane to terminate at a sharp bevelled point 23. In operation of the second working head, the tool is held in the hand approximately reversed from the position adopted for the use of the first working head and the point 23 is pressed into a joint from which there is caulk to be extracted. The operator then pulls or draws the point along the joint and the extract is dispersed from the joint along the underside cavity of the handle. The curved form 24 aids the structural stability of the point 23 and in combination with the cuts 31 to each of the side planes 27 improves the extent of access into a joint and its cavity by reducing the hindrance caused by contact between the tool and the surfaces adjacent to the joint. The point is further bevelled at 45 degrees to additionally aid access into a joint.

To use the first working head of the tool of the present invention, the tool handle is held firmly in the hand and the working head is pushed into a caulked joint such that the central cutting and chiselling point breaks into the caulk bead and is brought under hand pressure to rest at the confluence of the two adjacent joint surfaces 12. In this position, angled planes 13 will come to rest fully flush with those same surfaces. The tool is then pushed along the joint for the cutting and chiselling point 14 to chisel the caulk from the joint whilst the angled planes 13 simultaneously scrape the adjacent surfaces free of adhered caulk. The released strand of caulk is removed and collected along the V-shaped channel that extends between the two angled planes 13 and the rigid tip. The flexibility of the tool is demonstrated in that the tool can be variously manipulated to engage any of the scraping edges of the two angled planes in the removal of additional caulk on the surfaces.

Although the present invention has been described in some detail by way of example for purposes of clarity and understanding, it will be apparent that certain changes and modifications may be practised within the scope of the appended claims.

I claim:

1. A tool for the removal of a dead of caulk, sealant or other material from a joint at the intersection of two adjacent surfaces, comprising:

an elongate handle;

a working head at one end of the handle comprising a rigid tip and a pair of flexible guide members extending on opposite sides of the tip, each guide member having a surface extending forwardly of the end of the handle to form a substantially V-shaped channel adjacent the rigid tip;

whereby the tip acts to cut and lift the bead from the adjacent surfaces of the joint on insertion of the tip into the bead and advancement of the tool along the joint with the guide members engaging the two adjacent surfaces to assist in guidance and centering of the tip in the joint.

2. A tool as claimed in claim 1 in which the rigid tip comprises a bevelled chisel point extending forwardly and downwardly from the end of the handle.

3. A tool as claimed in claim 1 in which the surfaces extend forwardly of the end of the handle at an angle to each other of about ninety degrees or less.

4. A tool as claimed in claim 1 in which the rigid tip extends from the end of the handle to form an angled front face to the handle defining the bottom of the V-shaped channel.

5. A tool as claimed in claim 1 in which each surface is formed with a cutting edge to engage with the bead an assist in cutting the bead from the joint.

6. A tool as claimed in claim 5 in which each surface is generally trapezoidal with one of the edges of the trapezoid defining the region of attachment of the planar surface to the one end of the handle and the edge opposite the region of attachment defining the cutting edge.

7. A tool as claimed in claim 1 including a second working head at the opposite end of the handle from the working head.

8. A tool as claimed in claim 7 in which the second working head comprises a protruding hook member adapted for insertion into a joint.

9. A tool as claimed in claim 1 formed as a unitary member from resilient plastic.

10. A tool for the removal of a bead of caulk, sealant or other material from a joint at the intersection of two adjacent surfaces, comprising:

an elongate handle;

a working head at one end of the handle comprising a rigid tip and a pair of flexible guide members extending on opposite sides of the tip, each guide member having a generally trapezoidal surface extending forwardly of the one end of the handle to form a cutting edge to engage with the bead an assist in cutting the bead from the joint with one of the edges of the trapezoidal surface defining a region of attachment of the surface to the one end of the handle and the edge opposite the region of attachment defining the cutting edge;

whereby the tip acts to cut and lift the bead from the adjacent surfaces of the joint on insertion of the tip into the bead and advancement of the tool along the joint with the guide members engaging the two adjacent surfaces to assist in guidance and centering of the tip in the joint.

* * * * *

UNITED STATES PATENT AND TRADEMARK OFFICE

CERTIFICATE OF CORRECTION

PATENT NO : 6,035,536

DATED : March 14, 2000

INVENTOR(S) : Andrew Dewberry

It is certified that error appears in the above-identified patent and that said Letters Patent is hereby corrected as shown below:

In claim 1, line 1, replace "dead" with --bead--

Signed and Sealed this

Twentieth Day of March, 2001

Nicholas P. Godici

*Attest:*

NICHOLAS P. GODICI

*Attesting Officer*

*Acting Director of the United States Patent and Trademark Office*